US006830054B1

(12) United States Patent
Ross-Kuehn

(10) Patent No.: US 6,830,054 B1
(45) Date of Patent: Dec. 14, 2004

(54) METHOD FOR FABRICATING A HAIRPIECE AND DEVICE RESULTING THEREFROM

(76) Inventor: Stacey Ross-Kuehn, 211 W. 21st St., Apt. 3W, New York, NY (US) 10011

( * ) Notice: Subject to any disclaimer, the term of this patent is extended or adjusted under 35 U.S.C. 154(b) by 0 days.

(21) Appl. No.: 10/195,987

(22) Filed: Jul. 15, 2002

(51) Int. Cl.[7] ..... A41G 3/00; A41G 5/00
(52) U.S. Cl. ..... 132/201; 132/53; 132/56
(58) Field of Search ..... 132/201, 53, 54, 132/56; D28/92, 93

(56) References Cited

U.S. PATENT DOCUMENTS 1,634,190 A * 6/1927 Hepner ..... 132/53
1,638,016 A * 8/1927 Oppenheim ..... 132/53
2,651,310 A * 9/1953 Selson ..... 132/53
2,889,557 A * 6/1959 Blair ..... 132/53
3,521,648 A * 7/1970 Capparelli et al. ..... 132/53
3,782,396 A * 1/1974 Tomlinson ..... 132/53
3,812,867 A * 5/1974 Wanderman et al. ..... 132/53
4,599,749 A * 7/1986 Childs et al. ..... 2/199
4,600,029 A * 7/1986 Ueberschaar ..... 132/53
D294,876 S * 3/1988 Kuo ..... D28/92
5,551,452 A * 9/1996 Barlow ..... 132/210
5,806,535 A * 9/1998 Becker ..... 132/54
D445,217 S * 7/2001 Vidal ..... D28/92

* cited by examiner

*Primary Examiner*—John J. Wilson
*Assistant Examiner*—Robyn Kieu Doan
(74) *Attorney, Agent, or Firm*—Timothy Thut Tyson; Ted Masters; Freilich, Hornbaker & Rosen

(57) ABSTRACT

A method for fabricating a hairpiece includes attaching a plurality of hair wefts to an elastic band. The hair wefts are individually stitched to the elastic band leaving small gaps between adjacent hair wefts. In this fashion the elastic band can still expand after the hair wefts are attached. In a preferred embodiment, some of the hair wefts are double thickness to provide enhanced hair body.

14 Claims, 8 Drawing Sheets

Fig. 1
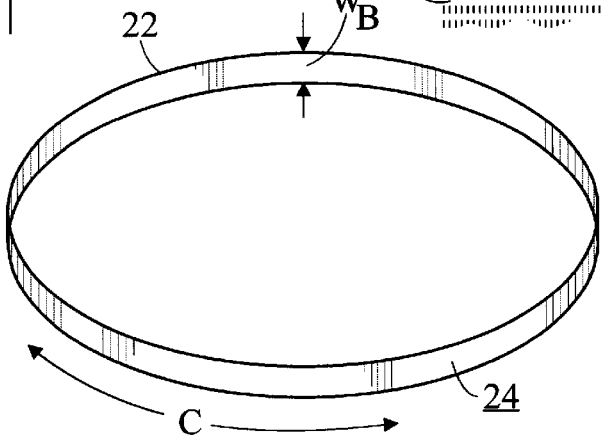
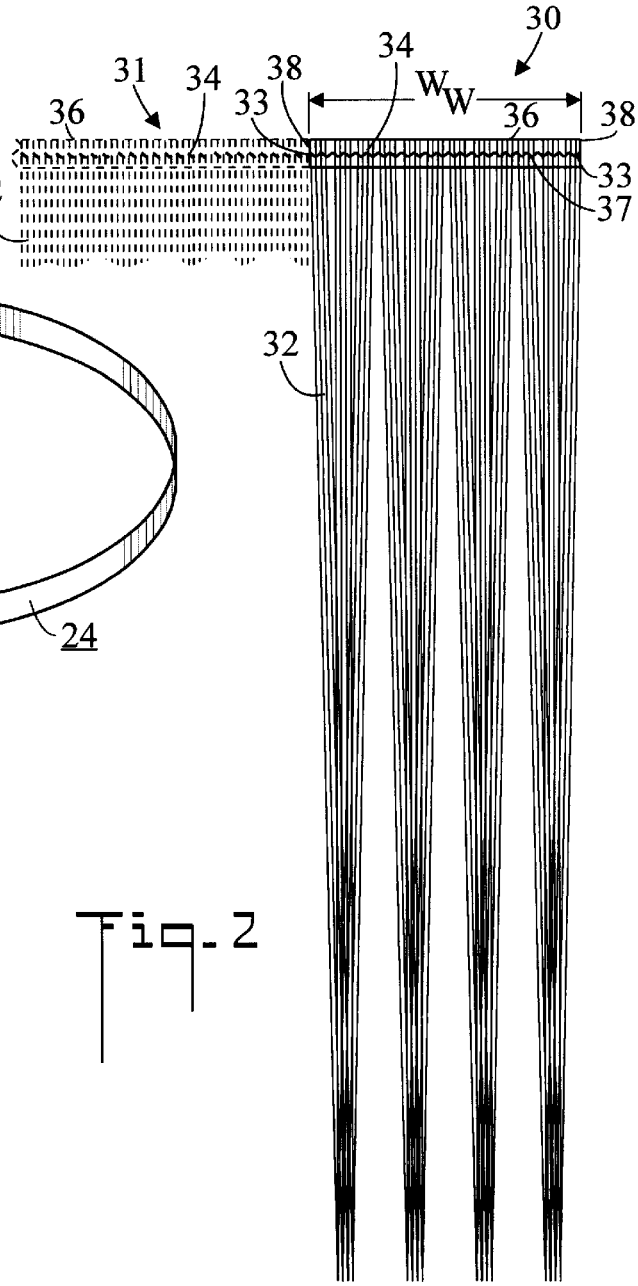
Fig. 2

Fig. 3
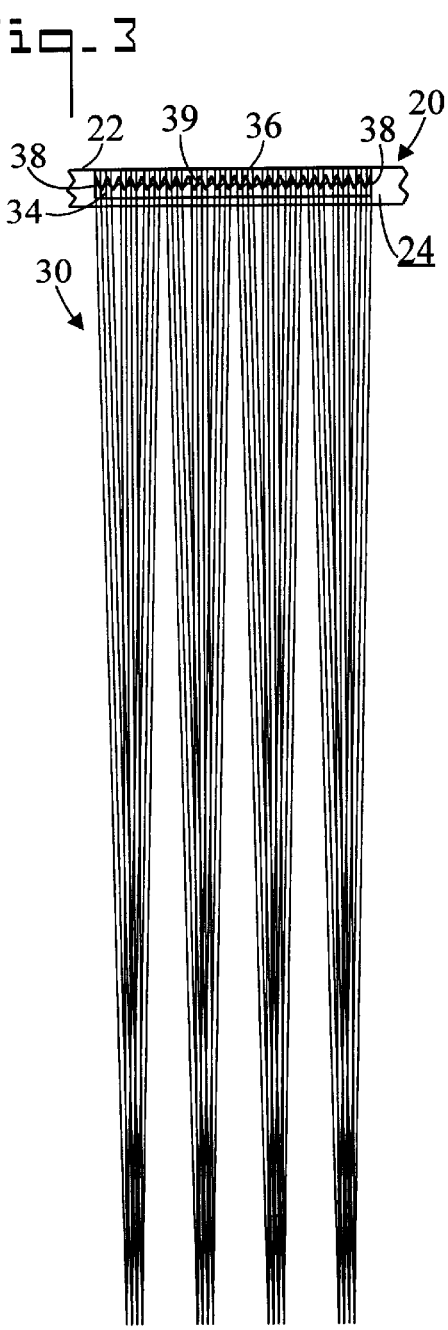
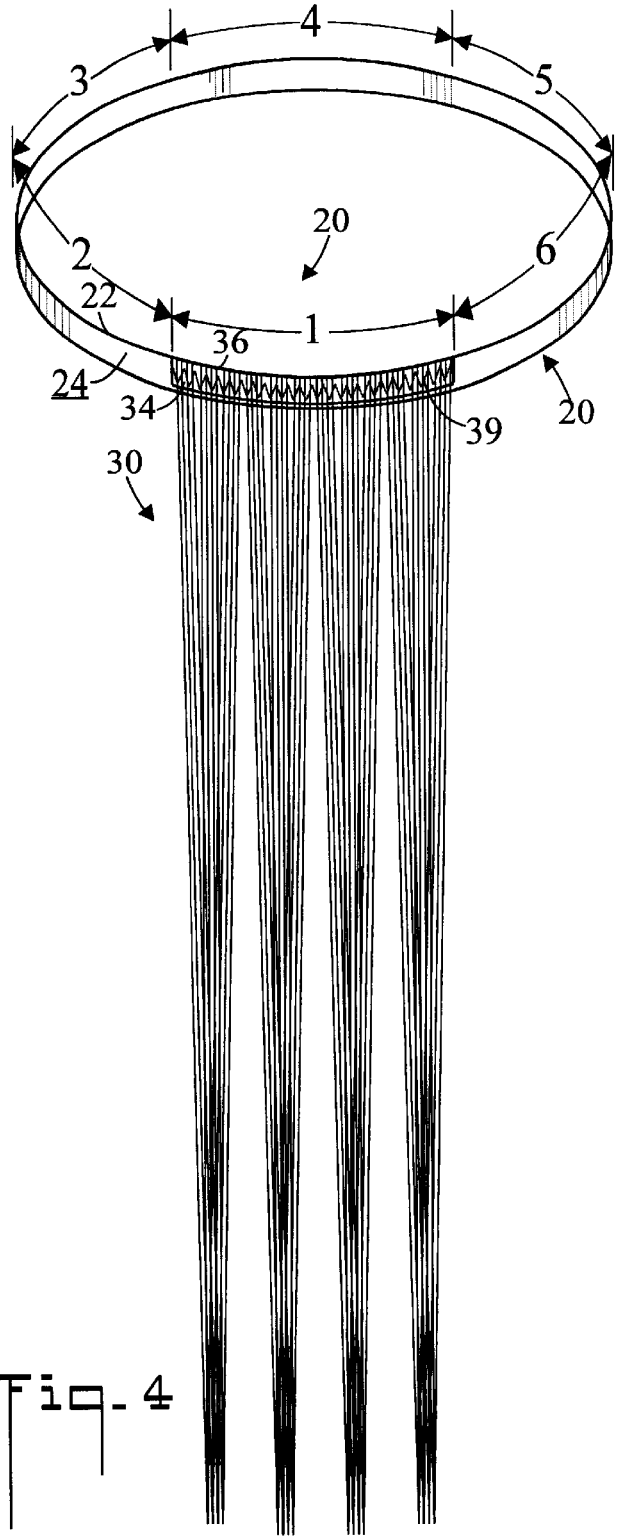
Fig. 4

Fig. 7
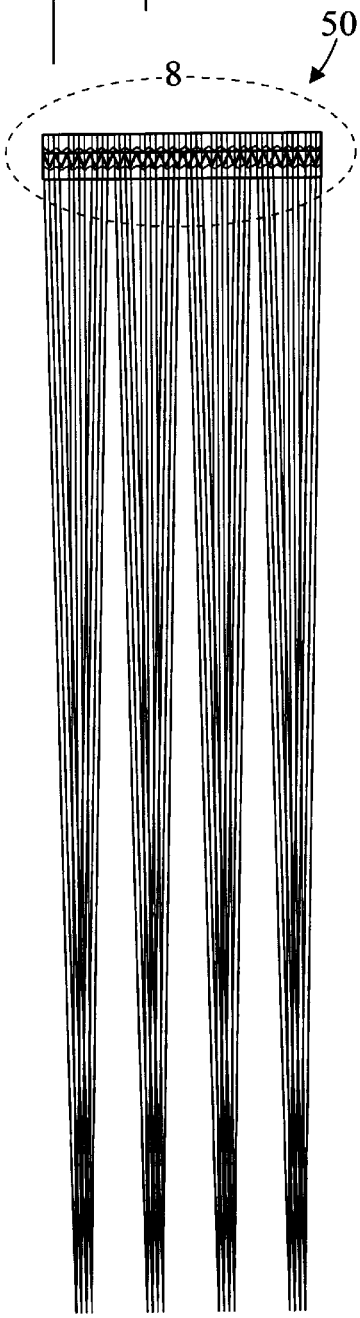
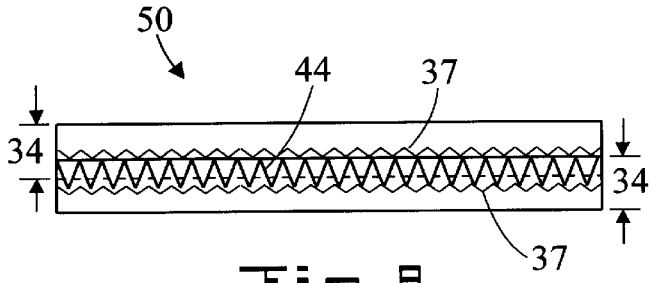
Fig. 8

METHOD FOR FABRICATING A HAIRPIECE AND DEVICE RESULTING THEREFROM

TECHNICAL FIELD

The present invention pertains generally to hair styling, and more particularly to a method for fabricating a hairpiece which may be worn by a user to supplement the user's own hair.

BACKGROUND OF THE INVENTION

Hairpieces are well known in the art. For example, U.S. Pat. No. D59,261 shows a hair fringe in which hair is disposed partially around a band.

U.S. Pat. No. 1,634,190 illustrates a hair structure which is worn by women who preferably have a permanently bobbed style of hair. The structure includes a foundation to which strands of hair are attached. The device includes an expansible elastic member.

U.S. Pat. No. 1,638,016 discloses a hairpiece attachment in which strands of hair are attached to a non-elastic band.

U.S. Pat. No. 2,651,310 shows a head conforming mounting for adjustably positionable hairpieces. The device includes a hairpiece which is attached to ribbon streamers.

U.S. Pat. No. 2,889,557 has of a boudoir cap with a plurality of curls spaced around the rim of the cap. An elastic band enables the rim of the cap to be stretched so that it can be placed on the head of the wearer.

U.S. Pat. No. 3,812,867 describes a capless wig in which hair weftings are spaced around a border elastic band.

U.S. Pat. No. 4,599,749 depicts a cap for wear by women to conceal partial or total hair loss. It has a main fabric piece with a curved top margin and a straight bottom margin with hems along both margins. A hairpiece retainer band consisting of a fabric strip is sewn at its opposite ends along the inside of the bottom hem. It provides between itself and the bottom hem a space to retain hairpiece simulating bangs. An elastic drawstring is provided in the top hem to gather the curved top margin into a tight loop. This creates many large folds in the top and back of the cap when worn to conceal the back of the head. It gives the appearance of a full head of hair while applying tension to the bottom margin. A retainer band holds the hairpiece in place in a readily adjustable manner.

U.S. Pat. No. 4,600,029 shows a hairpiece having a plurality of individual hairs adjustably secured about an endless circular filament or filaments and the method of placement on the head. The circular filament or filaments encircle the upper forward portion of the head. The sides and the lower back portion of the head are beneath an upper layer and above an underlying layer of hair. The hairpiece is thereby sandwiched between layers of the natural hair on the head.

U.S. Pat. No. 5,551,452 pertains to an adjustable hairpiece construction which includes a filamentary support element formed into a loop so as to fit around the head. Hair is affixed to the loop element in a manner allowing it to hang down. An adjustment assembly for adjusting the size of the loop has first and second bores. Portions of the support element extend through each of the bores. A releasable diameter fixing member is movable along the support element to fix the size of the loop.

U.S. Pat. No. 5,806,535 defines a head covering foundation article for a wig. It includes a stretchable net-like head band having a circumference approximately equal to the circumference of the head. Each band edge has an elasticized strip with loops adapted to be gripped by hook fabric fasteners. Hair extends upwardly and downwardly from both of the strips to simulate nape, forehead and crown hair.

U.S. Pat. No. D445,217 shows a light weight hairpiece having a plurality of hair placed around a band.

In the past, the most common methods of attaching pre-made extension wefts to a wearer's head have included gluing the extension wefts to the wearer's own hair or head with a strong bonding glue, bonding strands of extension hair to strands of the wearer's own hair with a strong bonding substance, and sewing extension wefts to a cornrow base of tightly woven braids on the wearer's own scalp made of the wearer's own hair. These methods are best performed by an expert hairdresser, and can cost hundreds of dollars.

SUMMARY OF THE INVENTION

The present invention is directed to a method of making a hairpiece. The product of the invention comprises an easy to use, inexpensive and temporary alternative to previous hair extensions. The invention makes available a variety of options in hair coloring and styling to an enormous group of people who may not have considered extensions as a viable option for themselves previously. Many people who may not have thought to try extensions in the past can now do so. The hairpiece of the present invention is easy to put on, comfortable to wear, and gives the wearer endless options as to the appearance of their hair. These options range from the introduction of a color to the wearer's own natural color which is evenly distributed in a natural way around the entire hairline and head, to the appearance of a different style of the wearer's own hair with no real difference in color. The hairpiece can be worn with endless possibilities of styling, and can be parted in any way which the wearer feels comfortable, or prefers. The hairpiece, when made of human hair, not only give endless possibilities for styling options, but also feels totally natural, is easy to care for, and will not bleed color or come out onto the wearer's own hair. The hairpiece can be cared for and washed easily by swishing gently in a sink filled with a combination of lukewarm water with a little bit of hair conditioner or fabric softener, rinsing gently, and hanging to air dry. The hair of the hairpiece is mounted on an elastic band, and will stay securely in place during normal use. A wearer can treat the hairpiece in the same manner as she would her own hair.

In accordance with a preferred embodiment of the invention, a method for fabricating a hairpiece includes:

(a)providing an elastic band which is shaped and dimensioned to fit around the head of a wearer, the band having a top rim, an outside surface, and a circumference;

(b) providing a hair member wherein multiple strands of hair are attached to an elongated pre-stitched band having a top;

(c) transversely cutting the pre-stitched band into sections to form a plurality of hair wefts, wherein each hair weft includes multiple strands of hair, the strands attached to the pre-stitched band having a top and opposite ends.

(d) with the elastic band in an unstretched state, stitching the pre-stitched band of each hair weft to the outside surface of the elastic band so that the top of each pre-stitched band substantially aligns with the top rim of the elastic band so that the hair wefts cover the elastic band, the hair wefts disposed in close circumferential relationship around the elastic band so that the hair wefts completely surround the circumference of the elastic band; and, (e) the stitching of the pre-stitched bands of the hair wefts to the elastic band comprising a plurality of separate stitch segments, wherein each pre-stitched band is separately stitched to the elastic band with one stitch segment and no stitch segment extends between adjacent pre-stitched bands leaving small unstitched gaps between adjacent pre-stitched bands.

In accordance with an important aspect of the invention, in step (b) the plurality of hair wefts include at least one double thick hair weft, the double thick hair weft including two hair wefts in which the pre-stitched bands of the two hair wefts are stitched together in a laterally offset arrangement.

Other aspects of the present invention will become apparent from the following detailed description, taken in conjunction with the accompanying drawings, which illustrate, by way of example, the principles of the invention.

BRIEF DESCRIPTION OF THE DRAWINGS

FIG. 1 is a perspective view of an elastic band;

FIG. 2 is a side elevation view of a hair weft;

FIG. 3 is a side elevation view of the hair weft stitched to the elastic band;

FIG. 4 is a perspective view of one hair weft stitched to the elastic band;

FIG. 7 is a side elevation view of a double thick hair weft;

FIG. 8 is an enlarged view of area 8 of FIG. 7.

DETAILED DESCRIPTION OF THE INVENTION

Figure 5:
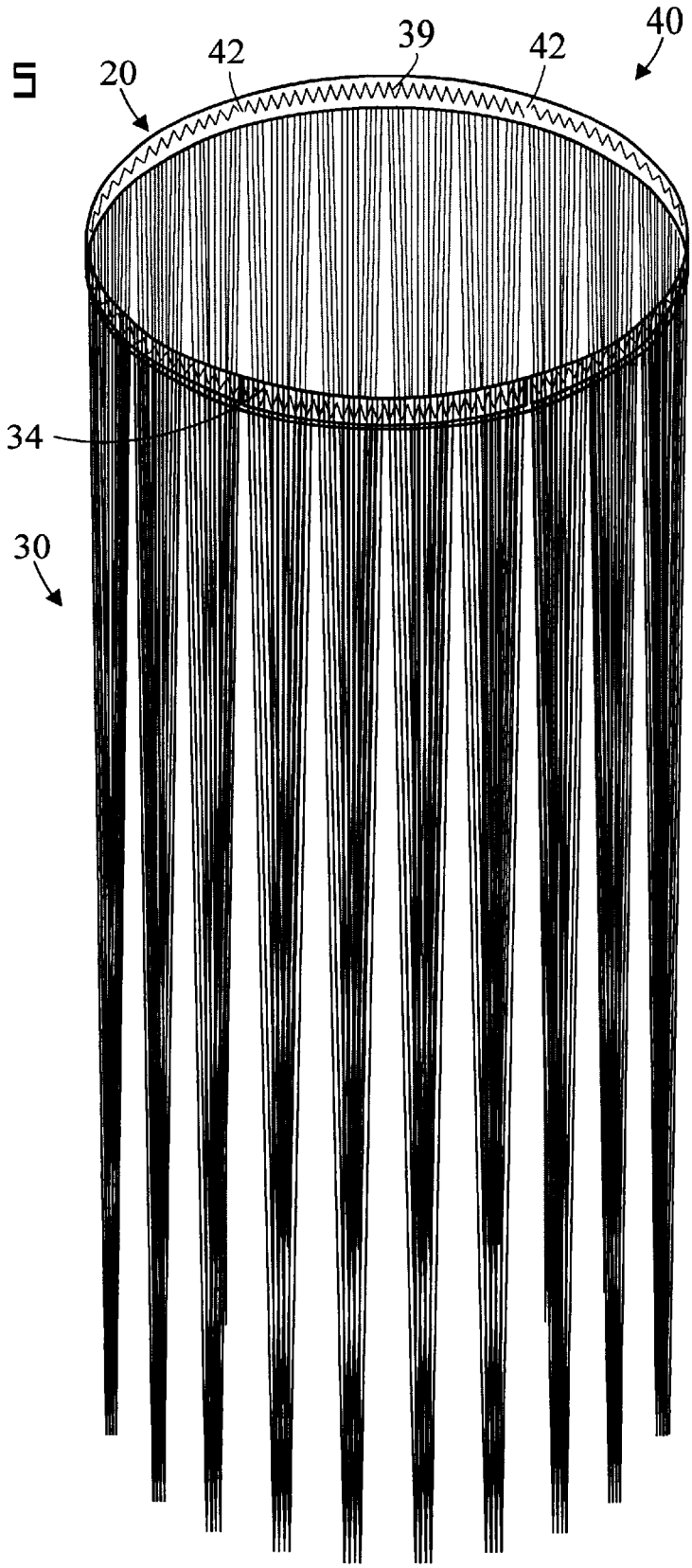
FIG. 5 is a perspective view of a plurality of hair wefts circumferentially stitched to the elastic band thereby forming a hair piece.

Referring initially to FIG. 1, there is illustrated a perspective view of an elastic band 20 which is shaped and dimensioned to resiliently fit around the head of a wearer. Elastic band 20 has a top rim 22, an outside surface 24, a circumference C, and a width $W_B$. In a preferred embodiment, width $W_B$ is between about 0.25 and 0.5 inches. Widths $W_B$ in this region are ideal for attaching hair wefts (refer to FIG. 2). Lesser widths $W_B$ would not be sufficient to attach the hair wefts, and wider widths could not be concealed by the hair wefts. As shown in FIG. 1, elastic band 20 is in a relaxed or unstretched state, and will circumferentially expand to accommodate the head of a wearer. Also in a preferred embodiment, circumference C is about 18 inches. Sturdy, stiffer elastic performs better than soft elastic because it helps the hairpiece hold its shape and stay in place on the wearer's head.

FIG. 2 is a side elevation view of a hair weft 30. Hair weft 30 includes multiple strands of hair 32. The strands of hair 32 are attached to a pre-stitched band 34 by stitching. Pre-stitched band 34 has a top 36 and opposite ends 38. Pre-stitching 37 attaches the strands of hair 32 to pre-stitched band 34. In a preferred embodiment at least some of the strands of hair 32 are at least about ten inches long. In many applications, this length is necessary to effect the desired hair styles. Hair wefts 30 are formed from an elongated hair member 31 (typically about 40 inches in length) having multiple strands of hair attached to an elongated pre-stitched band 34 having a top 36.The pre-stitched band 34 of the elongated hair member 31 is transversely cut into sections to form a plurality of hair wefts 30 each having two opposite ends. In a preferred embodiment of the invention, hair wefts 30 have one inch, two inch, and three inch widths $W_W$.

Elongated hairpiece 32 is preferably constructed from human hair, however synthetic hair may also be used. Human hair is preferred for several reasons. Human hair responds to heat and therefore can be styled with heat. Examples of heating devices used on human hair are curling irons, crimping irons, blow dryers, flat irons, and other heat styling tools available in the beauty industry. Human hair can also be styled and restyled, or simply washed and conditioned to start all over again. The texture of the human hair weft blends more naturally with the wearer's own hair than does the synthetic hair Human hair responds more naturally in the elements. And human hair weft can be cut to match the length of the wearer's own hair in a more believable way.

FIG. 3 is a side elevation view of hair weft 30 stitched to elastic band 20. Pre-stitched band 34 of hair weft 30 is stitched to outside surface 24 of elastic band 20 so that top 36 of pre-stitched band 34 substantially aligns with top rim 22 of elastic band 20. Hair weft 30 then covers elastic band 20. Pre-stitched band 34 is stitched to elastic band 20 with a zig-zag stitch segment 39. Stitch segment 39 does not extend beyond ends 38 of pre-stitched band 34.

FIG. 4 is a perspective view of one hair weft 30 stitched to elastic band 20. Pre-stitched band 34 is attached to band 20 with zig-zag stitch segment 39. In the shown embodiment, exactly six three inch wide hair wefts 30 are spaced around the circumference of elastic band 20. Using three inch wide hair wefts 30 is desirable because there are fewer gaps between hair wefts 30 on a completed hairpiece than with narrower wefts (refer also to FIG. 5 and the discussion pertaining thereto).

FIG. 5 is a perspective view of a hairpiece in accordance with the present invention, generally designated as 40, wherein a plurality of hair wefts 30 are circumferentially stitched,to elastic band 20. Hair wefts 30 are disposed in close circumferential relationship around elastic band 20 so that hair wefts 30 completely surround the circumference C of elastic band 20. In other words, ends 38 of adjacent pre-stitched bands 34 are placed in near abutting relationship around the circumference C of elastic band 20. The stitching of pre-stitched bands 34 of hair wefts 30 to elastic band 20 comprises a plurality of separate stitch segments 39, wherein each pre-stitched band 34 is separately stitched to elastic band 20 with one stitch segment 39, and wherein no stitch segment 39 extends between adjacent pre-stitched bands 34. In other words, a small unstitched gap 42 is left between hair wefts 30. If the stitching extended between adjacent pre-stitched bands 34, elastic band 20 would be less able to expand to resiliently accept the head of the wearer. It may be appreciated that stitch segments 39 may comprise a single stitch or multiple stitches.

It may also be appreciated the hair wefts 30 of different lengths may be used to effect different hair styles.

Figure 6:
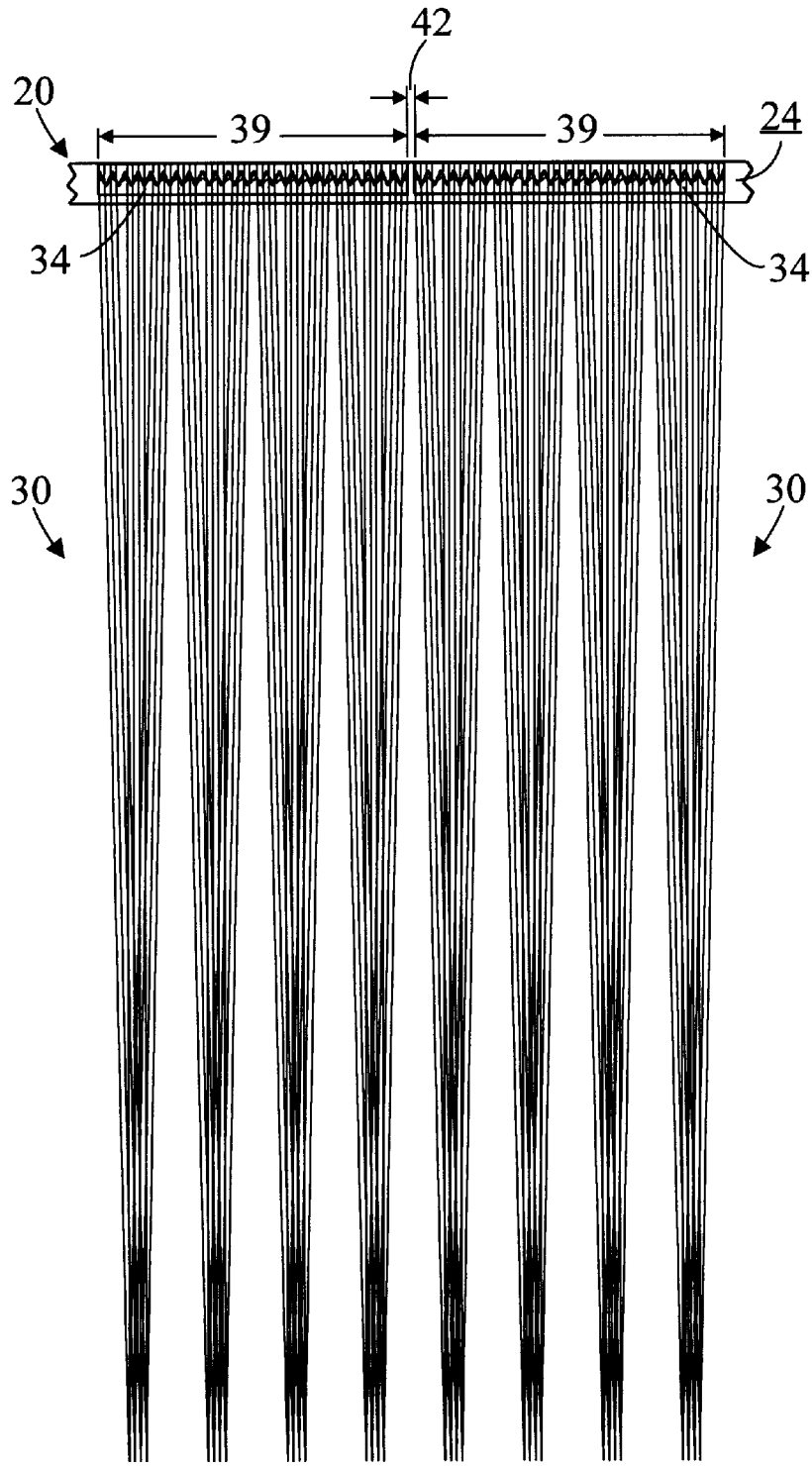
FIG. 6 is a side elevation view of adjacent hair wefts stitched to the elastic band.

FIG. 6 is a side elevation view of adjacent hair wefts 30 stitched to the elastic band 20. A small gap 42 exists between adjacent hair wefts 30. One stitch segment 39 attaches one hair weft 30 to elastic band 20 and another stitch segment 39 attaches the adjacent hair weft 30 to elastic band 20. The stitch segments 39 do not extend into gap 42 thereby allowing elastic band 20 to expand.

FIG. 7 is a side elevation view of a double thick hair weft 50, and FIG. 8 is an enlarged view of area 8 of FIG. 7. To provide additional hair thickness, this embodiment includes two hair wefts 30 in which the pre-stitched bands 34 of the two hair wefts 30 are stitched together in a laterally offset arrangement. That is, the two hair wefts 30 are slightly overlapped so that the pre-stitching 37 does not align. Were the pre-stitching 37 to align, the resulting structure would be unnecessarily thick. Zig-zag stitch 44 is then used to connect the two pre-stitched bands 34 together. In the shown embodiment, the top pre-stitched band 34 is lower than the bottom pre-stitched band 34. It may be appreciated that this arrangement could be reversed, with the top pre-stitched band 34 residing above the bottom pre-stitched band 34. That is, the overlap can be in either direction. In a preferred embodiment, hairpiece 40 includes exactly six hair wefts 30, four of which are double thick hair wefts 50.

In another possible embodiment of double thick hair weft 50, the two pre-stitched bands 34 are not first stitched together before they are attached to elastic band 20. Rather the two pre-stitched bands 34 are placed in offset relationship on elastic band 20, and then a single stitch is used to both stitch the pre-stitched bands 34 together and to stitch the pre-stitched bands 34 to elastic band 20.

In terms of manufacture, a method for fabricating a hairpiece 40 includes:

(a) providing an elastic band 20 shaped and dimensioned to fit around the head of a wearer, band 20 having a top rim 22, an outside surface 24, and a circumference C;

(b) providing a hair member 31 wherein multiple strands of hair 32 are attached to an elongated pre-stitched band 34 having a top 36;

(c) transversely cutting pre-stitched band 34 into sections to form a plurality of hair wefts 30, wherein each hair weft 30 includes multiple strands of hair 32, the strands 32 attached to pre-stitched band 34 having a top 36 and opposite ends 38;

(d) with elastic band 20 in an unstretched state, stitching the pre-stitched band 34 of each hair weft 30 to the outside surface 24 of elastic band 20 so that the top 36 of the pre-stitched band 34 substantially aligns with top rim 22 of the elastic band 20 so that hair wefts 30 cover elastic band 20, and wherein hair wefts 30 are disposed in close circumferential relationship around elastic band 20 so that hair wefts 30 completely surround the circumference C of the elastic band 20; and, (e) said stitching of the pre-stitched bands 34 of hair wefts 30 to elastic band 20 comprising a plurality of separate stitch segments 39, wherein each pre-stitched band 34 is separately (individually) stitched to elastic band 20 with one stitch segment 39, and wherein no stitch segment 39 extends between adjacent pre-stitched bands 34. That is, a small unstitched gap 42 exists between adjacent pre-stitched bands 34.

The method further includes:

in step (c) the plurality of hair wefts 30 including at least one double thick hair weft 50, the double thick hair weft 50 including two hair wefts 30 in which the pre-stitched bands 34 of the two hair wefts 30 are stitched together in a laterally offset arrangement.

The method further includes:

in step (c), hairpiece 40 including exactly six hair wefts, four of which are double thick hair wefts 50.

The method further includes:

in step (c), the pre-stitched band 34 of the hair wefts 30 having a width of about three inches, so that exactly six hair wefts 30 are disposed around band 20.

The method further includes:

in step (a), elastic band 20 being between about 0.25 and 0.5 inches wide.

The method further includes:

in step (c), at least one of the hair wefts 30 having strands 32 which are at least about ten inches long.

The method further includes:

in step (d), the stitching including a back stitch 33 at each of the opposite ends 38 to prevent the ends 38 of hair weft 30 from unraveling.

Method of Use

Figure 9:
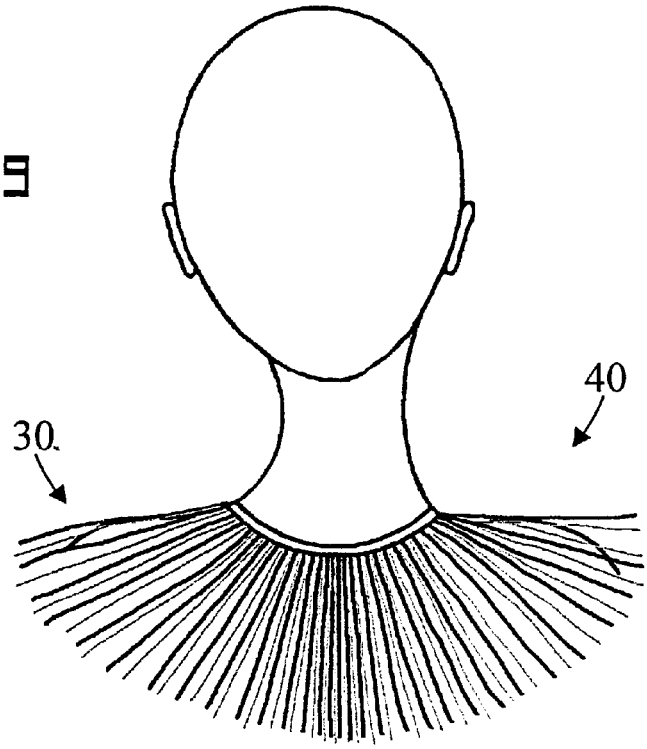
FIG. 9 is a front elevation view of the hairpiece pulled over the head and resting around the neck of a wearer.

Referring to FIG. 9, elastic band 20 with hair wefts 30 streaming downward is pulled over the entire head until it rests around the neck like a necklace with the seam of the elastic band 20 where it has been sewn together in the back of the head at the nape of neck.

Figure 10:
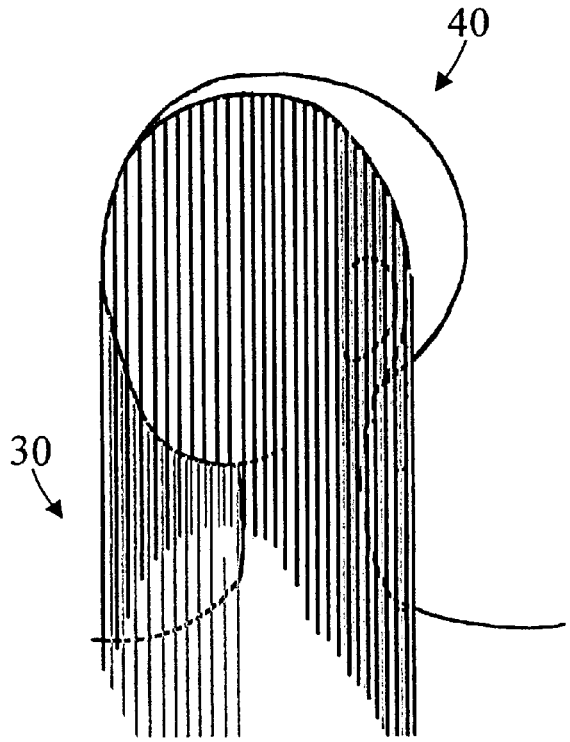
FIG. 10 is a front side view of the hairpiece placed upon the head of the wearer.

Referring to FIG. 10, the front of elastic band 20 is grasped between the fingers, pulled up until it is about 1–2 inches above the front hairline, and positioned so that it rests on the head with elastic band 20 located behind the ears in a position similar to that of a normal headband. Elastic band 20 takes on the shape of the wearer's head and is held securely in place by the elasticity.

Figure 11:
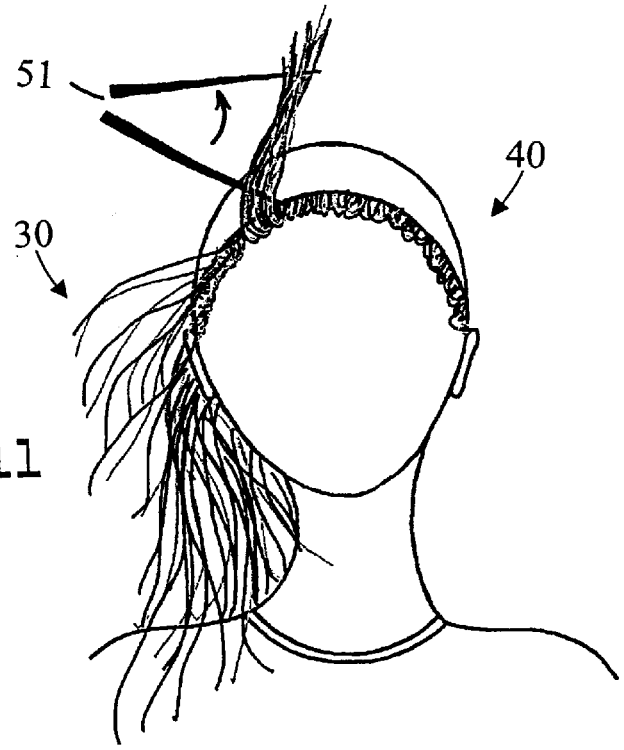
FIG. 11 is a front elevation view of the wearer's hair being loosened around the hairline.

Referring to FIG. 11, the wearer's own hair along the entire hairline in front of elastic band 20 is loosened so it is free flowing and blends with the hair of hairpiece 40. In order to loosen the hair of the wearer's own hairline, a pointed object 51, such as a chopstick, is placed underneath the hair trapped under the band. The pointed object is then pulled in an outward motion until the hair trapped underneath elastic band 20 comes loose all the way to the ends. This process is repeated at several different positions along the hairline on the front, sides and back of the hairline and along the nape of the neck. The hair along the hairline is untucked and loosened all the way around the entire head in this manner so that at least one inch of the wearer's own hair lies in front of elastic band 20 and is loose and free flowing with the hair of the extension piece.

Figure 12:
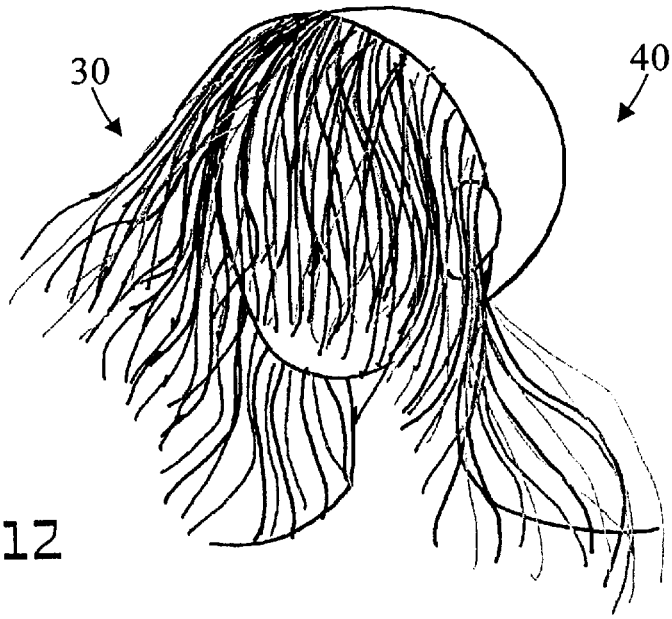
FIG. 12 is a front side view of the hairpiece blended with the wearer's hair.

Referring to FIG. 12, when hairpiece 40 is placed on the head in this method, it blends in with the wearer's own hair in a natural looking way. It lies comfortably at an angle with the front raised and resting a few inches from the wearer's front hairline, and the back positioned against the nape of the neck. This angle gives the appearance that the hairpiece 40 is shorter in the front than it is in the back. Because it is made out of human hair, it can be cut to customize it for the wearer.

The hairpiece 40 has many variations:

Use in fine hair: The back and sides of the hairpiece 40 can be made thicker for people who have fine hair. The three inch hair wefts 30 used to make the piece are doubled up, as previously described, before being sewn to the elastic band 20. Two three inch sections of weft 30 are sewn to each other with a zig-zag stitch 44 in a way so that one of them rests just slightly above the other in order to keep the wefts 30 from becoming too bulky to attach to the elastic band 20. Four of these doubled up sections are sewn to the elastic band 20 at the back and sides of the hairpiece 40 in order to create thicker sections of hair at the back and sides of the wearer's head. Single sections of hair weft 30 are used for the remaining two sections at the front of the head to ensure that the hair blends properly with the wearer's own hair.

Figure 13:
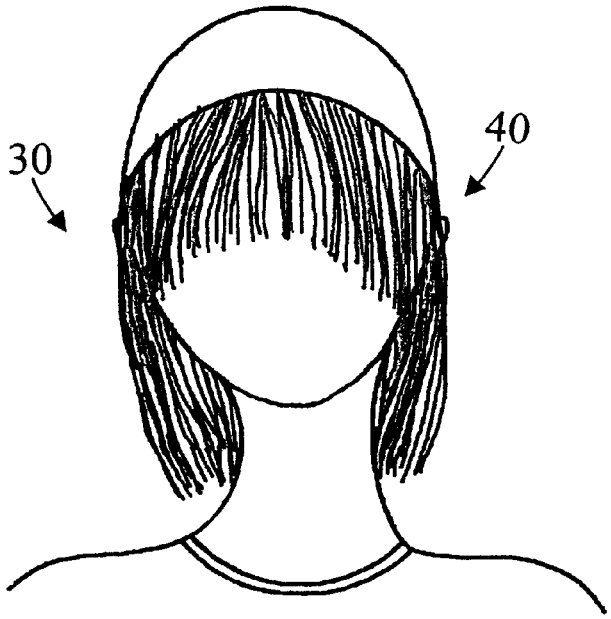
FIG. 13 is a front view of hair wefts of different lengths.

Layering: Referring to FIG. 13, shorter hair wefts 30 are used at the front of hairpiece 40 with the hair wefts 30 becoming longer as they graduate toward the back of the wearer's head to create an effect of layering. This can be done in an endless variety of ways according to any look a person wants to try.

Highlighting: Two hair wefts 30 are sewn together for the purpose of color. For example, a pale blonde hair weft 30 is sewn to a honey blonde hair weft 30 before being attached to elastic band 20 to create a more natural highlighting color. This variation is used by a wearer who wants to try changing her hair color or who wants to try highlighting her hair, but is not ready to commit to a permanent hair coloring process.

Figure 14:
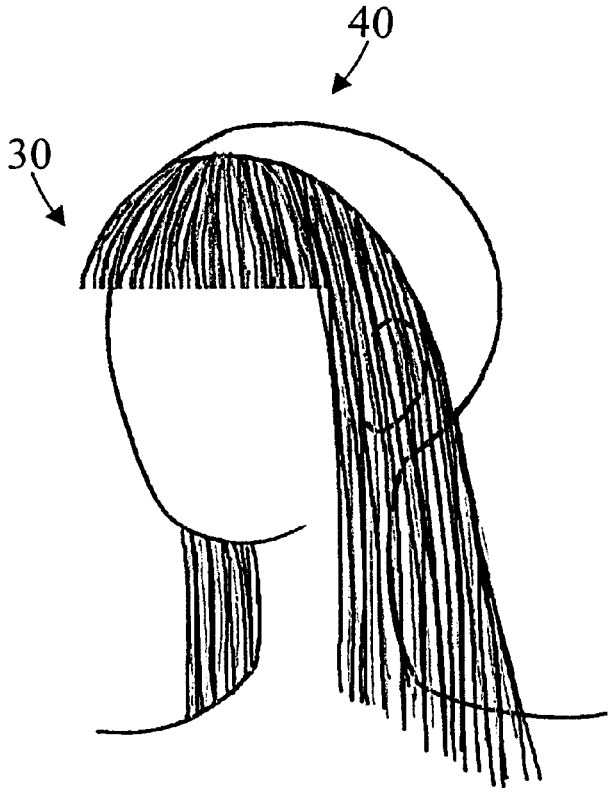
FIG. 14 is a front side view of shorter wefts in front to simulate bangs.

Bangs: Referring to FIG. 14, hair wefts 30 can be short in the front with a strong line to simulate bangs. A wearer who already has bangs can wear this piece to change the color of her hair. It can also be used by a wearer who has short or medium length layers in her hair to create bangs without cutting her own hair. Placing hairpiece 40 a little further back from the front hairline gives the appearance of a shorter bang, and moving it forward closer to the hairline makes the bang appear longer.

Color: Endless possibilities exist. Funky teenagers can experiment with the color of their hair in unnatural or unusual shades without worrying about school standards or displeasing their parents. People who want to try coloring their hair but aren't ready to commit to permanent change can experiment with different colored hairpieces. People who like to experiment with different shades of hair color on a regular basis can change their appearance without damaging their own hair. Mature women who want their hair to appear thicker can use hairpieces having natural colors in the mature range of colors (grays, salt and pepper). People who like to change the way their hair looks for different occasions can select different hairpieces. A wearer can select a color or length that is completely different from the wearer's own for the purpose of dress-up or costume.

Texture: Hairpiece 40 can be made in many different textures ranging from straight to a medium curl, and anything in between. Using a hairpiece 40 in hair that has a strong curl requires more expertise. If the texture of the hairpiece matches the texture of the wearer's own hair, the hairpiece will virtually blend in completely with the wearer's own hair.

The hairpiece 40 is removed from the head by grasping the portion along the front hairline, and pulling upward slowly until the entire piece is free from the head. The hairpiece 40 should be hung when not in use to prevent tangling.

It is possible to wear more than one hairpiece 40 at a time if one piece is positioned on the head slightly farther back from the hairline than the other. The hairpiece positioned the farthest back from the hairline should be the first one put on.

Hairpiece 40 is more secure on the head and more comfortable than previous extension pieces which use clips, combs, pins, ribbons, springs, hair ties or bands of plastic or fabric to hold them in place. It enhances or changes the appearances of the wearer's own natural hair. It is not meant to conceal or cover up the wearer's own hair as is the case with wigs or wiglets.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A method for fabricating a hairpiece, comprising:

(a) providing an elastic band shaped and dimensioned to fit around the head of a wearer, said band having a top rim, an outside surface, and a circumference;

(b) providing a hair member wherein multiple strands of hair are attached to an elongated pre-stitched band having a top;

(c) transversely cutting said pre-stitched band into sections to form a plurality of hair wefts each having two opposite ends;

(d) with said elastic band in an unstretched state, stitching said pre-stitched band of each said hair weft to said outside surface of said elastic band so that said top of said pre-stitched band substantially aligns with said top rim of said elastic band so that said hair wefts cover said elastic band, and wherein said hair wefts are disposed in close circumferential relationship around said elastic band so that said hair wefts completely surround said circumference of said elastic band; and, (e) said stitching of said pre-stitched bands of said hair wefts to said elastic band comprising a plurality of separate stitch segments, wherein each said pre-stitched band is separately stitched to said elastic band with one said stitch segment, and wherein no said stitch segment extends between adjacent said pre-stitched bands.

2. The method of claim 1, further including:

in step (c), said plurality of hair wefts including at least one double thick hair weft, said double thick hair weft including two said hair wefts in which said pre-stitched bands of said two hair wefts are stitched together in a laterally offset arrangement.

3. The method of claim 2, further including:

in step (c), said hairpiece including exactly six said hair wefts, four of which are said double thick hair wefts.

4. The method of claim 1, further including:

in step (c), said pre-stitched band of said hair wefts having a width of about three inches, so that exactly six said hair wefts are disposed around said band.

5. The method of claim 1, further including:

in step (a), said elastic band being between about 0.25 and 0.5 inches wide.

6. The method of claim 1, further including:

in step (b), at least one of said hair wefts having strands which are at least about ten inches long.

7. The method of claim 1, further including:

a back stitch at each of said opposite ends to prevent said ends of said hair weft from unraveling.

8. A hairpiece, comprising:

an elastic band shaped and dimensioned to fit around the head of a wearer, said band having a top rim, an outside surface, and a circumference;

a plurality of hair wefts, wherein each hair weft includes multiple strands of hair, said strands attached to a pre-stitched band having a top and opposite ends;

when said elastic band is in an unstretched state, said pre-stitched band of said hair wefts stitched to said outside surface of said elastic band so that said top of said pre-stitched band substantially aligns with said top rim of said elastic band so that said hair wefts cover said elastic band, and wherein said hair wefts are disposed in close circumferential relationship around said elastic band so that said hair wefts completely surround said circumference of said elastic band; and, said stitching of said pre-stitched bands of said hair wefts to said elastic band comprising a plurality of separate stitch segments, wherein each said pre-stitched band is separately stitched to said elastic band with one said stitch segment, and wherein no said stitch segment extends between adjacent said pre-stitched bands.

9. A hairpiece according to claim 8, further including:

said plurality of hair wefts including at least one double thick hair weft; and, said double thick hair weft including two said hair wefts in which said pre-stitched bands of said two hair wefts are stitched together in a laterally offset arrangement.

10. A hairpiece according to claim 9, further including:

said hairpiece including exactly six said hair wefts, four of which are said double thick hair wefts.

11. A hairpiece according to claim 8, further including:

said pre-stitched band of said hair wefts having a width of about three inches, so that exactly six said hair wefts are disposed around said band.

12. A hairpiece according to claim 8, further including:

said elastic band being between about 0.25 and 0.5 inches wide.

13. A hairpiece according to claim 8, further including:

at least one of said hair wefts having strands which are at least about ten inches long.

14. A hairpiece according to claim 8, further including:

said elastic band being between about 0.25 and 0.5 inches wide;

said pre-stitched band of said hair wefts having a width of about three inches, so that exactly six said hair wefts are disposed around said band;

at least one of said hair wefts having strands which are at least about ten inches long;

said plurality of hair wefts including at least one double thick hair weft, said double thick hair weft including two said hair wefts in which said pre-stitched bands of said two hair wefts are stitched together in a laterally offset arrangement; and, said hairpiece including exactly six said hair wefts, four of which are said double thick hair wefts.

* * * * *